US009228745B2

(12) United States Patent
Koskela et al.

(10) Patent No.: US 9,228,745 B2
(45) Date of Patent: Jan. 5, 2016

(54) CLEANER EQUIPMENT FOR THE SMELT SPOUTS OF A RECOVERY BOILER

(75) Inventors: Hannu Koskela, Tampere (FI); Ari Saarela, Lempäälä (FI); Kalle Salmi, Tampere (FI)

(73) Assignee: Valmet Technologies Oy, Espoo (FI)

( * ) Notice: Subject to any disclaimer, the term of this patent is extended or adjusted under 35 U.S.C. 154(b) by 708 days.

(21) Appl. No.: 13/008,222

(22) Filed: Jan. 18, 2011

(65) Prior Publication Data

US 2011/0109023 A1 May 12, 2011

Related U.S. Application Data

(63) Continuation of application No. 11/907,585, filed on Oct. 15, 2007, now Pat. No. 7,891,325.

(30) Foreign Application Priority Data

Oct. 16, 2006 (FI) ..... 20065657

(51) Int. Cl.
*F22B 37/48* (2006.01)
*F23J 1/06* (2006.01)
*F23J 1/08* (2006.01)

(52) U.S. Cl.
CPC ..... *F23J 1/06* (2013.01); *F23J 1/08* (2013.01)

(58) Field of Classification Search
CPC ..... F28G 7/00; F22B 37/56; F22B 37/48
USPC ..... 122/379; 110/173 R, 182.5, 297; 15/104.15; 134/104.1, 167 R, 169 R; 162/47, 48, 272; 266/135
See application file for complete search history.

(56) References Cited

U.S. PATENT DOCUMENTS

| | | | | |
|---|---|---|---|---|
| 3,196,088 | A | 7/1965 | Coleman | |
| 3,606,162 | A * | 9/1971 | Lehmann | 39/227 |
| 4,423,533 | A | 1/1984 | Goodspeed | |
| 4,706,324 | A * | 11/1987 | Goodspeed | 15/246 |
| 4,748,004 | A | 5/1988 | Goodspeed | |
| 4,822,428 | A * | 4/1989 | Goodspeed | 134/6 |
| 5,167,192 | A * | 12/1992 | Pingel et al. | 110/182.5 |
| 5,307,745 | A * | 5/1994 | Higgins et al. | 110/182.5 |
| 5,348,234 | A | 9/1994 | v.d. Woude | |
| 5,381,811 | A | 1/1995 | Boisture | |
| 5,414,887 | A * | 5/1995 | Abel et al. | 15/104.16 |
| 5,542,650 | A * | 8/1996 | Abel et al. | 266/135 |

(Continued)

FOREIGN PATENT DOCUMENTS

| | | | |
|---|---|---|---|
| JP | 2001108226 | A | 4/2001 |
| WO | WO-03/093747 | A1 | 11/2003 |

OTHER PUBLICATIONS

European Search Report—Nov. 28, 2013 (Issued in Counterpart Application No. 07397033.7).

(Continued)

*Primary Examiner* — Gregory A Wilson
(74) *Attorney, Agent, or Firm* — Venable LLP; Eric J. Franklin

(57) ABSTRACT

A cleaning unit for smelt spouts of a recovery boiler. A motorized cleaning member is configured to clean smelt spouts of a recovery boiler. A motorized transfer device is configured to transfer the cleaning unit from the location of a first smelt spout to the location of a second smelt spout.

18 Claims, 6 Drawing Sheets

(56) References Cited

U.S. PATENT DOCUMENTS

| | | | | |
|---|---|---|---|---|
| 5,950,902 | A * | 9/1999 | Moore, Sr. | 227/130 |
| RE36,465 | E * | 12/1999 | Boisture | 134/22.1 |
| 6,257,156 | B1 | 7/2001 | Kaulamo | |
| 6,655,397 | B2 * | 12/2003 | Brown et al. | 134/167 R |
| 7,367,288 | B2 | 5/2008 | Kim | |
| 7,475,645 | B2 * | 1/2009 | Engvall | 110/182.5 |
| 7,625,518 | B2 * | 12/2009 | Pingel | 266/235 |
| 7,900,567 | B2 * | 3/2011 | Haaga et al. | 110/193 |
| 2003/0217706 | A1 * | 11/2003 | Pingel et al. | 122/387 |
| 2007/0272130 | A1 | 11/2007 | Eriksson et al. | |
| 2008/0079203 | A1 | 4/2008 | Gibowski | |
| 2010/0154691 | A1 * | 6/2010 | Sainio et al. | 110/348 |

OTHER PUBLICATIONS

European Patent Office Communication Pursuent to Article 94(3) EPC—Jul. 22, 2015 (Issued in Counterpart Application No. EP 07397033.7).

* cited by examiner

CLEANER EQUIPMENT FOR THE SMELT SPOUTS OF A RECOVERY BOILER

CROSS-REFERENCE TO RELATED APPLICATIONS

This application is a continuation application of U.S. patent application Ser. No. 11/907,585 filed 15 Oct. 2007, and claims priority under 35 USC §119 to Finnish Patent Application No. 20065657 filed on Oct. 16, 2006

FIELD OF THE INVENTION

The invention relates to a cleaning unit for a smelt spout of a recovery boiler. The invention also relates to a cleaning apparatus for a smelt spout of a recovery boiler and to a method for cleaning a smelt spout of a recovery boiler.

BACKGROUND OF THE INVENTION

The spent lye, i.e. the so-called black liquor created in pulp manufacture is burnt in a recovery boiler, on one hand, in order to recover the energy it includes, and on the other hand, in order to recover the chemicals in it and to recycle them back to circulation. A char bed is created on the bottom of the recovery boiler when burning black liquor, which in a high temperature forms into smelt, which is removed from the boiler as a continuous flow via smelt spouts to a dissolving tank.

Below the furnace is located the cover area of a dissolving tank of the recovery boiler, i.e. the smelt spout area, where the smelt from the lower part of the furnace is directed along the so-called smelt spout to the dissolving tank. FIG. 1 shows a typical smelt spout area of a recovery boiler, which comprises smelt spouts 1, along which the smelt is directed from the furnace 2 to the dissolving tank 3.

Typically, the smelt is very hot (for example 750 to 820° C.). The possible splashes of smelt cause danger to the personnel working and moving in the surroundings. Because of this, there is typically a protection area near the smelt spouts, moving on which area should be avoided and working on which area requires using special protection equipment.

However, it is necessary to work in the vicinity of the smelt spouts relatively often, because the operation of the smelt spouts must be monitored periodically. In practice, smelt accumulates on the surfaces of the smelt spout, which smelt tends to solidify and cause plugging. When necessary, pile-up and pluggings must be removed from the smelt spouts in order for the smelt to be able to travel to the dissolving tank in a desired manner.

The smelt spout cleaning means are typically hand tools used by the operating personnel, such as, for example, cleaning rods. To increase work safety, motor-operated smelt spout cleaning means have been developed, where the cleaning means are moved by a motor, thus cleaning the smelt spout.

SUMMARY OF THE INVENTION

Now a solution for cleaning smelt spouts has been invented, which solution increases work safety.

To attain this purpose, the cleaning unit of a smelt spout according to the invention is primarily characterized in that the unit comprises a motorized cleaning member for cleaning the smelt spout, wherein the cleaning unit comprises motorized transfer means for transferring the cleaning unit to the location of the smelt spout. The cleaning apparatus of smelt spouts according to the invention, in turn, is primarily characterized in that the apparatus comprises a motorized cleaning member for cleaning the smelt spout, wherein the cleaning apparatus comprises a path and a cleaning unit, which comprises motorized transfer means for transferring the cleaning unit to the location of the smelt spout via the path. The method according to the invention is primarily characterized in that in the method the smelt spout is cleaned with a motorized cleaning unit, wherein the cleaning unit is transferred in a motorized manner to the location of the smelt spout to be cleaned.

The basic idea of the invention is to use one moving cleaning means unit, i.e. cleaning unit for cleaning two or more smelt spouts. In an embodiment there is one cleaning unit on one wall of the boiler, in which case all the smelt spout on the wall can be cleaned by, for example, one cleaning unit. In a typical recovery boiler there is one or more smelt spouts, and for example in large recovery boilers there may be over ten smelt spouts. The cleaning unit moves to the location of the smelt spout to be cleaned and it cleans one smelt spout at a time.

The cleaning unit for the smelt spout of a recovery boiler comprises motorized transfer means for transferring the unit to the location of the smelt spout. Here a motorized transfer means refers to all such means that create movement irrespective of the source of power or direction of movement. For example, the movement power can be created by electricity, pressurized air or other pressurized medium, and the direction of movement of the source of power can be, for example, linear or rotating.

In an advantageous embodiment the transfer means are arranged to move the cleaning unit horizontally in the direction of the wall of the recovery boiler. In an embodiment the cleaning unit is arranged movable in such a manner that its direction of movement is perpendicular to the cleaning movement, which cleaning movement is substantially perpendicular to the boiler wall.

In an embodiment the cleaning unit comprises a carriage, which comprises at least a part of the transfer means for moving the cleaning unit.

The cleaning member of the cleaning unit comprises advantageously at least a first arm part and a second arm part, and the first arm part is connected to the carriage with a first hinging structure and to the second arm part with a second hinging structure. In the previous embodiment the cleaning member further comprises a changeable cleaning tool, which is attached to the second end of the second arm part.

In an embodiment the cleaning unit further comprises means for using the cleaning device of the air nozzle of the recovery boiler.

The cleaning apparatus for the smelt spout of a recovery boiler according to the invention comprises a path and a cleaning unit, which comprises motorized transfer means for transferring the unit to the location of the smelt spout along the path. In an advantageous embodiment the path is parallel to the boiler wall. Preferably the path is connected to the boiler wall.

In an embodiment the cleaning unit is suspended from the path, in which case the cleaning member of the cleaning unit is substantially placed in the area under the path. An embodiment is suspended from above in such a manner that the moving cleaning unit can travel above the floor. Thus, the structures of the cleaning apparatus do not need to be placed on the floor and the floor is free for other use. Thus, an advantage in an embodiment is the unobstructed passage to the smelt spout area. In an embodiment other structures can be placed on the floor level.

In the method for cleaning the smelt spout of a recovery boiler which implements the invention, the smelt spout is cleaned with a motorized cleaning unit and the cleaning unit is moved in a motorized manner to the location of the smelt spout to be cleaned. Preferably several smelt spouts are cleaned with one cleaning unit.

The different embodiments of the invention offer various advantages over solutions of prior art. There can be one or more of the following advantages in an application depending on its implementation.

less cleaning units than in known solutions are needed
the number of maintenance destinations decreases
expenses decrease
mountability
maintainability
enables unobstructed passage to spouts and air nozzles
enables wide cleaning area

DESCRIPTION OF THE DRAWINGS

In the following, the invention will be described in more detail with reference to the appended principle drawings, in which.

DETAILED DESCRIPTION OF THE INVENTION

Figure 1:
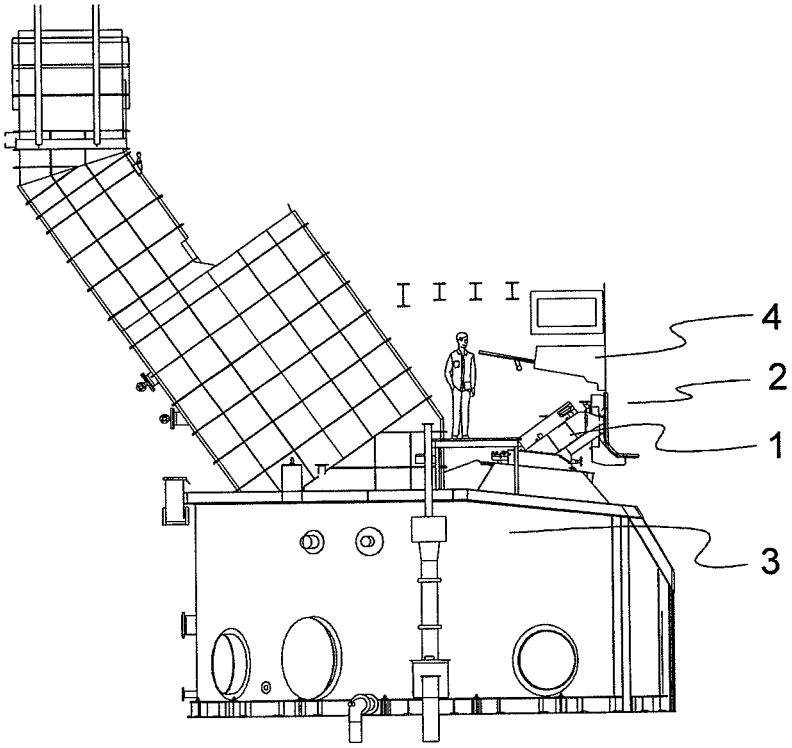
FIG. 1 shows a smelt spout area according to prior art

FIG. 1 shows a present smelt spout area of a recovery boiler. The area comprises smelt spouts 1, along which the smelt is directed from a furnace 2 to a dissolving tank 3. In addition, the figure shows primary air level air nozzles 4, which are placed above the smelt spouts 1.

Figure 2:
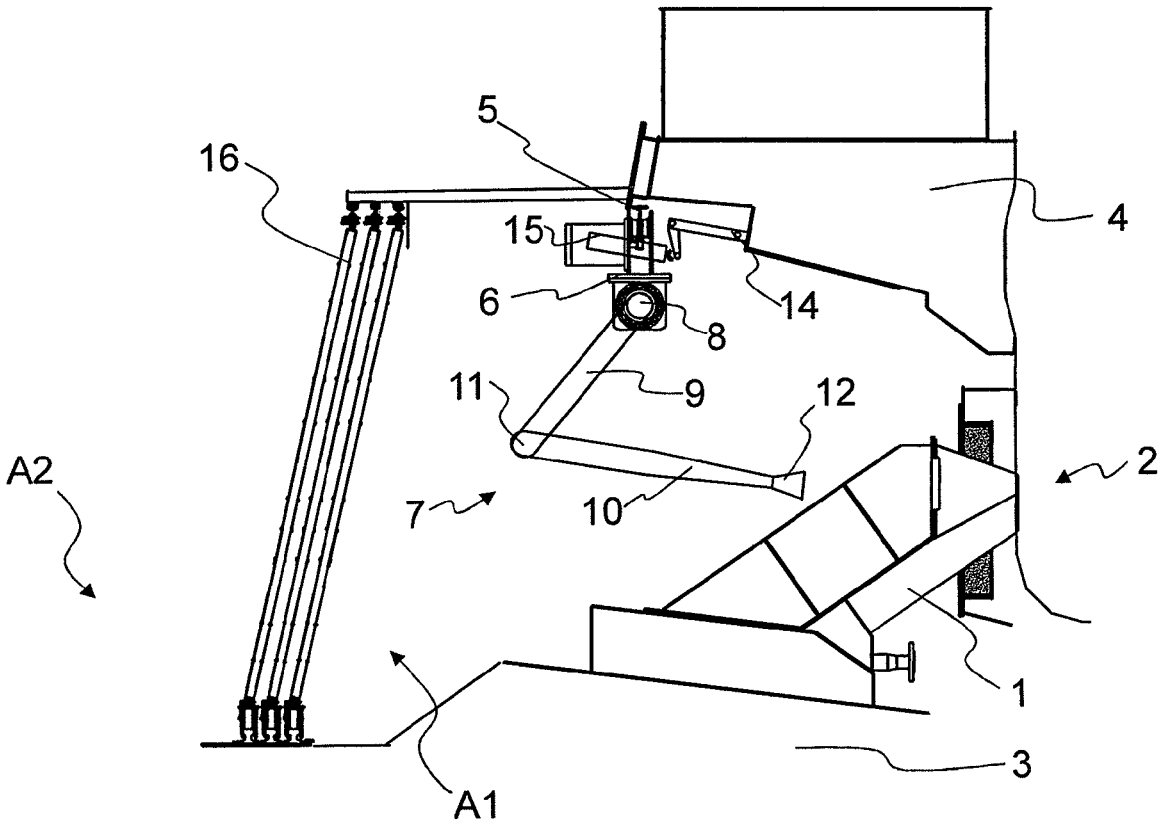
FIG. 2 shows a side view of a cleaning device in a first position

FIG. 2 shows an embodiment of a cleaning apparatus for smelt spouts 1 of a boiler. The cleaning apparatus comprises a moving cleaning unit, a path 5 and a control unit (not shown in the figure). In the figure the path 5 is formed by a rail i.e. a guide bar connected to the wall. The cleaning unit, in turn, is formed by a carriage 6 and a cleaning member 7, which are described more in detail later in the description. The cleaning unit may travel along the path 5 horizontally parallel to the wall of the boiler. By attaching the rail 5 to the boiler wall the mutual position of the ran and the smelt spouts 1 remains substantially constant irrespective of the temperature of the wall. The dimensions of the boiler wall typically change when the temperature changes due to the thermal expansion of the material.

The path 5, which here refers to the structure guiding the carriage 6 of the cleaning unit, can also be implemented in several ways. The path 5 can be, for example, a guide bar or a rail, which directs and supports the cleaning unit. In an advantageous embodiment the rail 5 or a corresponding structure is connected together with the boiler wall. The cleaning unit is preferably fitted mainly below the rail 5, i.e. the cleaning unit is in a way suspended from the rail. Advantageously the rail 5 enables as unobstructed movement as possible to the area below the rail. The rail 5 can in some embodiments be located below the cleaning unit or on its side as well. It is possible to place the rail 5 in other ways as well, but then the variation in the locations of different parts caused by thermal expansion must be taken into account with some other solutions.

The cleaning unit travelling on the path 5 comprises the previously mentioned carriage 6 and cleaning member 7. The cleaning unit is connected to the path 5 via the carriage 6 of the cleaning unit and the cleaning unit can travel horizontally parallel to the wall by means of an actuator, such as, for example, an electric motor. In the embodiment according to the example the carriage 6 is arranged to travel supported by the rail 5. The carriage 6 and/or the rail 5 comprise suitable transmission structures and glide structures, by means of which the carriage can move from one position to another. The cleaning member 7 is connected to the carriage 6 in such a manner that the cleaning member can travel at least towards the boiler and away from the boiler and advantageously vertically as well. In the example the carriage 6 and the cleaning member 7 are connected to each other via a first pivot 8 (hinging structure), such as, for example a gear system. The first pivot 8 enables the turning of the cleaning member 7 in relation to the axis line of the pivot (gear system), in which case the end of the cleaning member can move in the height direction. In an embodiment the cleaning member 7 can also turn horizontally in relation to the carriage 6.

In an application according to the example the cleaning member 7 comprises at least two arm parts, in the example a first arm part 9 and a second arm part 10. In the example the carriage 6 and the first arm part 9 are connected to each other via a first pivot 8, such as, for example, a gear system. The first pivot 8 enables the turning of the first arm part 9 in relation to the axis line of the pivot (gear system), in which case the end of the first arm part connected to the second arm part 10 can move in the height direction. The arm parts are connected to each other with a second pivot 11 (hinging structure) in such a manner that they can turn. Different structures can be used for connecting, such as, for example, joint structures or gear systems. There may also be more arm parts 9, 10 than the first and second arm part shown in the example. Similarly there may be more hinging structures than the shown first and second pivot 8, 11. Versatile paths of movement are enabled by several moving arm parts.

The cleaning member 7 can be equipped with different cleaning tools 12. For example, at the end of the second arm part 10 it is possible to fit different tools 12. The tool 12 can be, for example, a brush, a paddle, a chisel or some other device. It is also possible to use a functional device as the tool 12, such as, for example, a water nozzle, a pneumatic nozzle, or a device producing vibration and/or shocks. In addition, the cleaning member 7 can comprise several tools 12. For example, a brush-like tool 12 is placed at the end of the second arm part 10 of the cleaning member 7 and a pressure washer nozzle is fitted on the side of the arm part. In an embodiment a tool 12 placed at the end of the arm part 10 can be automatically changed, in which case the tool can be fitted for the purpose as well as possible. For example, changeable tools 12 can be located at a tool changing station, where the cleaning unit is directed for changing tools.

As can be seen from FIGS. 2 to 5, the two arm parts 9, 10 and two pivots 8, 11 of the cleaning member 7 enable bringing the cleaning member into different positions. Different positions enable the efficient and versatile cleaning of the smelt spout 1. FIG. 2 shows the cleaning unit in a position where the cleaning member 7 does not touch the smelt spout 1. This position enables, inter alia, moving the cleaning unit along the path 5.

Figure 3:
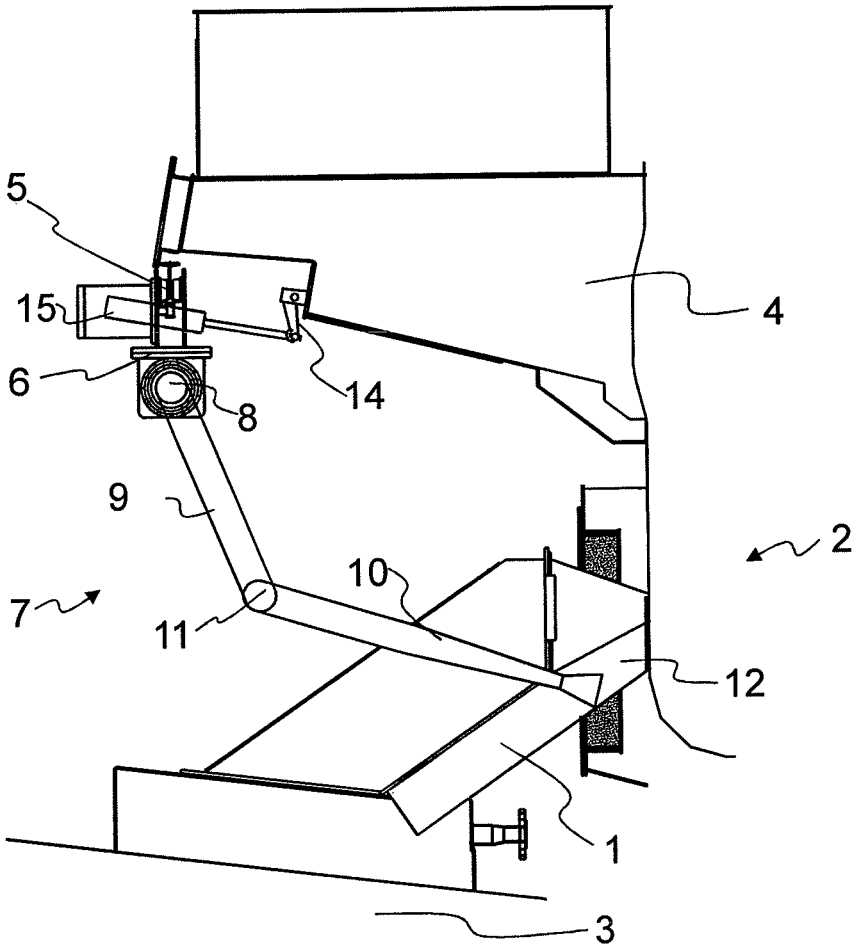
FIG. 3 shows a cleaning device in a second position

FIG. 3 shows the smelt spout 1 in a cross-sectional view. In the figure it can be seen how the tool 12 of the cleaning member 7 cleans the upper part of the smelt spout 1. The opening connecting the smelt spout 1 to the boiler can also be cleaned in a corresponding manner by turning the arm parts 9, 10 in such a manner that the tool 12 meets the opening.

Figure 4:
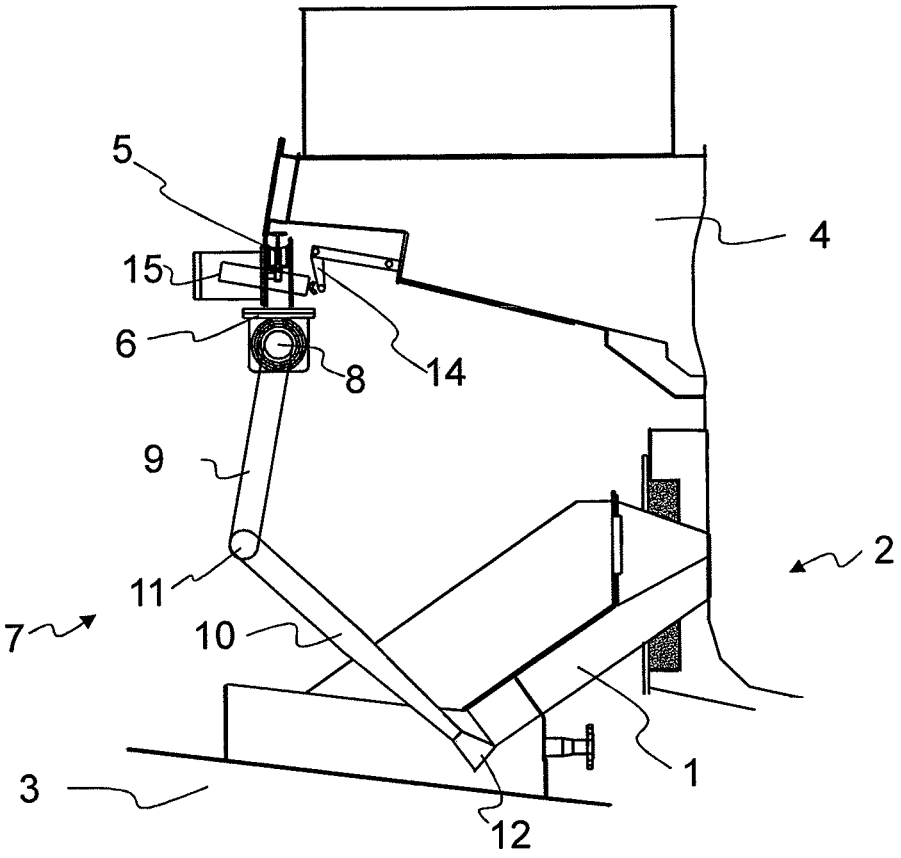
FIG. 4 shows a cleaning device in a third position

FIG. 4, in turn, shows the position of the cleaning member 7 when the lower part of the smelt spout 1 is cleaned. The cleaning member 7 can application-specifically be brought to other positions as well, as is shown in the figures.

Figure 5:
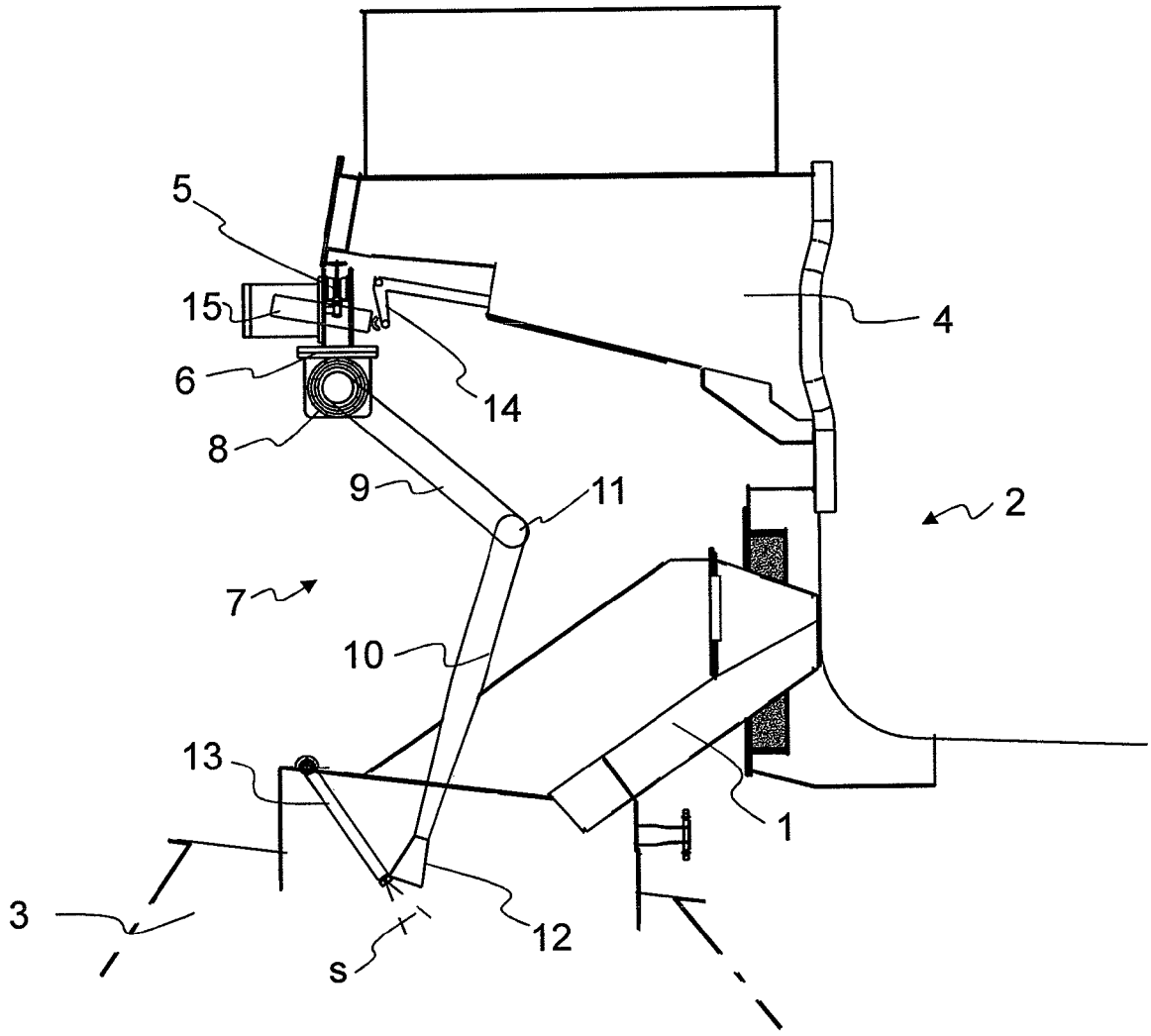
FIG. 5 shows a cleaning device in a fourth position

An application also comprises a steam shattering device 13 or other smelt flow shattering device. FIG. 5 shows a working phase for cleaning the steam shattering device 13. Thus the cleaning member 7 is directed into such a position, that the steam shattering device it can clean. FIG. 5 shows an embodiment of the steam shattering device, where the jet S atomizing the smelt flow is directed inside the dissolving tank. The steam shattering device 13 or other smelt flow shattering device can be implemented in different manners and it can be placed in different locations as well. The cleaning can be performed, for example, mechanically or with a suitable medium jet.

Figure 6:
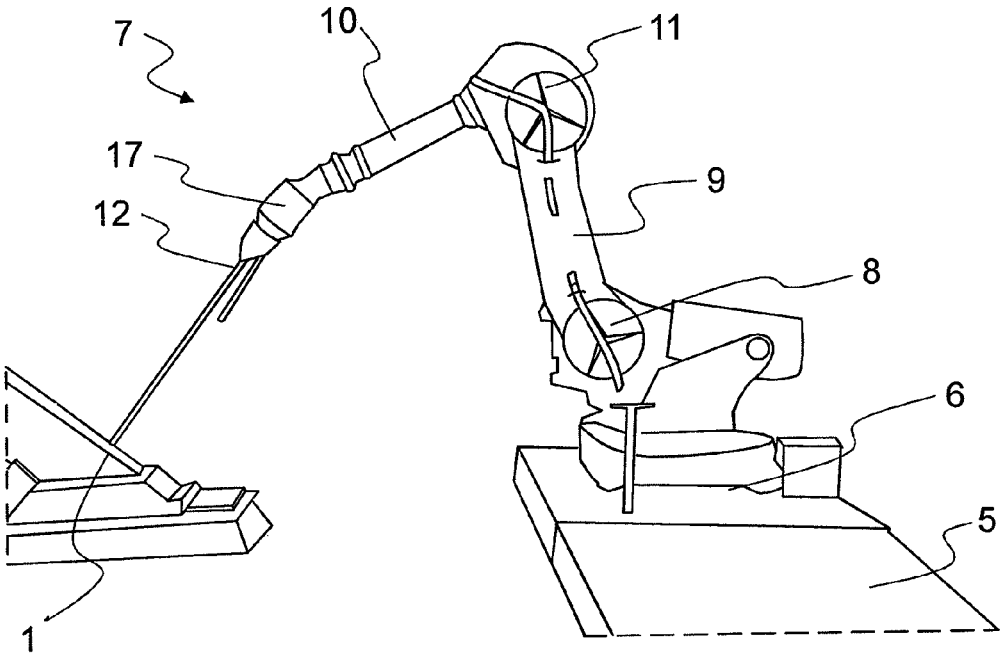
FIG. 6 shows another embodiment of a cleaning device For the sake of clarity, the figures only show the details necessary for understanding the invention. The structures and details that are not necessary for understanding the invention but are obvious for anyone skilled in the art have been omitted from the figures in order to emphasize the characteristics of the invention.

FIG. 6 shows another embodiment of a cleaning apparatus for smelt spouts 1 of a boiler. The cleaning apparatus comprises a moving cleaning unit and a control unit (not shown in the figure). In the example the cleaning unit is an industrial robot, which is arranged to clean several smelt spouts 1. In the example, in addition to a first arm part 9 and a second arm part 10, the cleaning member 7 of the cleaning unit comprises an end effector 17 connected to the second arm part. The end effector 17 is advantageously connected to the second arm part 10 in such a manner that the end effector can turn in relation to the arm part. To the end effector 17, in turn, has been connected a tool 12 or a suitable tool changer. For example, the cleaning unit can move in front of the smelt spouts 1 via a suitable path 5, which is on the floor in the example. It is also possible that the cleaning unit according to the example comprises transfer means for turning the cleaning unit to the cleaning spout 1 being cleaned. For example, in an embodiment one cleaning unit can be used to clean three smelt spouts 1 by turning the robot and/or the arm of the robot horizontally. Thus, the cleaning unit can be placed in one position, from where the cleaning of several smelt spouts 1 is performed. In a solution, several adjacent cleaning units are used, each of which is used to clean several smelt spouts 1 by turning the cleaning unit. Using an industrial robot with several degrees of freedom as a cleaning unit also enables versatile paths, by means of which it is possible to perform various tasks. For example, by means of suitable tools 12 it is possible to perform monitoring, cleaning or closing/opening of various hatches, doors and walls.

As the actuators creating the dynamics of the cleaning device it is possible to use devices suitable for the purpose, such as, for example, different electric motors, hydraulic and pneumatic actuators and their direction of movement can be, for example, linear or rotating. The actuators can be placed in various ways. For example, they can be located centralized in connection with the carriage 6, from where the power is transferred with suitable structures to the arm parts 9, 10 and other necessary targets. The actuators can also be placed in different locations of the cleaning device and/or cleaning unit, in which case the movement of the arm part 9, 10 is created by an actuator in the arm part or in the connection 8, 11 of the arm part.

In order to determine the location of the cleaning unit, it is possible to use various solutions. The path 5 can comprise identification structures, by means of which the location and/or positioning of the cleaning unit can be made. In an embodiment the positioning takes place by means of computer vision and in an application measuring members are used, and the position is determined on the basis of the measuring information received from them. It is also possible to use different mechanical, electrical and/or optical switches and controls (such as, for example, different limit switches).

FIGS. 2 to 5 show cleaning means for an air nozzle as well. In the example the cleaning means for an air nozzle comprise a cleaning member 14, which in the example is nozzle-specific, as well as an actuator 15, which is fitted into the carriage 6 of the cleaning unit. Thus, several air nozzles can be taken care of with one actuator 15. In FIG. 2 the actuator 15 is in the free position, in which case the cleaning member 14 is not in the air nozzle. In FIG. 3 the actuator 15 is in the work position, in which case the cleaning member 14 is projected into the air nozzle.

The example of FIG. 2 also shows a protective wall 16. The protective wall 16 separates the smelt spout area A1 and the working area A2 from each other. The working area A2 means an area where the personnel must stay and/or move when the boiler is in use. The protective wall 16 can be opened and closed, in which case, inter alia, service and maintenance work targeted at the immediate vicinity of the smelt spouts can be performed by opening the necessary area of the protective wall. The protective wall 16 can comprise, for example, several door elements, which can be moved in the direction of the boiler wall.

By placing the cleaning equipment of smelt spouts 1 in the area between the protective wall 16 and the boiler wall (smelt spout area A), as shown in FIG. 2, the cleaning apparatus can be separated from the working area A2. Thus, work safety is also improved, when the moving equipment is separated form the working area A2.

The operation of the cleaning device is controlled by a control unit. The control unit can be implemented in a variety of ways. For example, the functions of the control unit can be implemented by programming and the program can be either in its own data processing unit or in a data processing unit together with some other program. In an application the commands of the control unit are a part of the other command set of the boiler usage control program. Program-based control enables arranging the control smelt-spout-specifically, if necessary. Thus, it is possible to note the individual features of smelt spouts 1 and their possible effects on cleaning.

Programming the program-based control can be implemented in various ways, such as by inputting the commands separately to a control unit or by guiding or teaching the desired function to the control unit. In the programming, inter alia the paths of movement of the cleaning member 7 and information connected to the carriage 5 movement is determined.

The program comprises the necessary commands for implementing the cleaning method. The method may comprise, for example, work phases with which the cleaning unit is forced to the location of the smelt spout, the protective hatch of the smelt spout is opened, the smelt spout is cleaned, the surroundings of the smelt spout are cleaned, the hatch of the smelt spout is closed. Naturally there may be more or less work phases depending on the application. A working phase may also comprise sub-work phases. For example, the smelt spout cleaning work phase may comprise phases for cleaning the boiler opening, the upper part of the spout and the lower part of the spout.

Separate commands may also be provided for maintenance. For example, a cleaning unit determined as serviceable can be moved to the desired location, for example to the edge area away from the immediate vicinity of the boiler wall. In addition, the arm parts 9, 10 can pre-settle in a pre-determined position, in which case the most typical maintenance work is easy and fast to perform.

The above-described cleaning apparatus can be used in several different ways. In an application the cleaning of smelt spouts 1 is performed as a continuously repeated set. Thus, the smelt spouts 1 are cleaned periodically. For example, the cleaning unit cleans the smelt spouts 1 of one wall of the boiler one at a time in a row. After cleaning the first smelt spout 1 the cleaning unit moves to the next smelt spout and cleans it and then moves further to the next smelt spouts. When all the smelt spouts 1 have been cleaned, the cleaning unit can return back to the starting point to wait for the beginning of the next cleaning round. It is also possible to determine that some smelt spouts 1 are cleaned more often and some less frequently, if differences have been noticed in the plugging-sensitivity of the smelt spouts.

In an application the cleaning is started separately by the user or the supervisor. Thus, when the personnel detects a need for cleaning, the cleaning is started. The cleaning can in an embodiment be directed at all smelt spouts 1, in which case the cleaning unit automatically cleans all the smelt spouts after receiving a start-up command. In an embodiment, a smelt spout 1 that must be cleaned is determined, and the cleaning unit automatically cleans the smelt spouts determined to be cleaned after receiving a start-up command.

In an embodiment the smelt spouts 1 that are plugged and/or are about to be plugged are identified automatically and the cleaning unit automatically cleans the smelt spouts in need of cleaning. Some suitable monitoring means can be used for the identification, such as, for example, computer vision or some other sensor that follows the smelt flow or a feature connected to it. The monitoring means can be smelt-spout-specific application-specifically, or several smelt spouts can be monitored with one monitoring means. In an embodiment the monitoring means is placed in a carriage moving on the path 5, in which case the monitoring can be performed by moving the carriage from one smelt spout 1 to another. The carriage can be a separate monitoring carriage and the monitoring means can be placed in the cleaning unit.

In an embodiment the cleaning unit can be controlled manually. Thus, the person can in a suitable manner control the operation and movement of the cleaning unit. For example, taking care of difficult plugging and unusual situations is therefore possible. Control can take place, for example, by means of a portable control unit or by remote usage from the control room. Remote usage often requires visual information, which is why it is advantageous to place a camera in the cleaning unit.

In an embodiment there is one cleaning unit on one wall of the boiler. For example, there may be nine smelt spouts 1 on a wall, in which case one cleaning unit can clean nine smelt spouts. In another embodiment there are, in turn, two or more cleaning units on one wall of the boiler. Thus, it is possible to service one cleaning unit and at the same time use another cleaning unit for cleaning the smelt spouts 1. Using several cleaning units also enables equipping the cleaning units in different ways, in which case in different situations it is possible to use a differently equipped cleaning unit.

It is also possible to combine the above-described applications and embodiments in such a manner that the created solution comprises two or more of the above-described structures and/or modes of operation. For example, the cleaning unit can comprise different actuators and different sensors and it may be possible to control in various ways.

By combining, in various ways, the modes and structures disclosed in connection with the different embodiments of the invention presented above, it is possible to produce various embodiments of the invention in accordance with the spirit of the invention. Therefore, the above-presented presented examples must not be interpreted as restrictive to the invention, but the embodiments of the invention may be freely varied within the scope of the inventive features presented in the claims hereinbelow.

The invention claimed is:

1. A cleaning unit for cleaning at least two smelt spouts of a recovery boiler one at a time, the cleaning unit comprising:

a motorized cleaning member comprising a cleaning tool and configured to clean a first smelt spout of a recovery boiler; and a motorized transfer device configured to transfer the cleaning unit including the motorized cleaning member and cleaning tool from a location of the first smelt spout to a location of a next, second smelt spout of the recovery boiler, wherein the motorized cleaning member comprising the cleaning tool is further configured to clean the second smelt spout.

2. The cleaning unit according to claim 1, wherein the transfer device is configured to transfer the cleaning unit parallel to a wall of the recovery boiler.

3. The cleaning unit according to claim 1, further comprising:

a monitoring device configured to identify a plugged smelt spout or a smelt spout about to be plugged.

4. The cleaning unit according to claim 1, further comprising:

an air nozzle cleaning device configured to clean air nozzles of the recovery boiler.

5. The cleaning unit according to claim 1, wherein the cleaning unit is configured to travel along a guiding structure from the first smelt spout to the second smelt spout to clean the smelts spouts one at a time.

6. The cleaning unit according to claim 1, wherein the recovery boiler comprises further smelt spouts, and wherein the cleaning unit is configured to travel along a guiding structure from one smelt spout to another smelt spout to clean the smelts spouts one at a time.

7. A cleaning apparatus for cleaning at least two smelt spouts of a recovery boiler one at a time, the cleaning apparatus comprising:

a cleaning unit having a motorized cleaning member comprising a cleaning tool and configured to clean a first smelt spout of a recovery boiler;

a motorized transfer device configured to transfer the cleaning unit including the motorized cleaning member comprising the cleaning tool from a location of the first smelt spout to a location of a next, second smelt spout, wherein the motorized cleaning member comprising the cleaning tool is further configured to clean the second smelt spout; and a guiding structure along which the cleaning unit is configured to travel to transfer from the first smelt spout to the second smelt spout to clean the smelts spouts one at a time.

8. The cleaning apparatus according to claim 7, wherein the guiding structure is horizontal and parallel to a wall of the recovery boiler.

9. The cleaning apparatus according to claim 8, wherein the guiding structure is connected to the recovery boiler.

10. The cleaning apparatus according to claim 7, wherein the cleaning unit is suspended from the guiding structure.

11. The cleaning apparatus according to claim 7, further comprising:

a carriage configured to move the cleaning unit along the guiding structure, the carriage comprising at least a part of the motorized transfer device, wherein the cleaning unit is connected to the path via the carriage.

12. The cleaning apparatus according to claim 7, wherein the recovery boiler comprises further smelt spouts, and wherein the cleaning unit is configured to travel along the guiding structure from one smelt spout to another smelt spout for cleaning the smelts spouts one at a time.

13. The cleaning apparatus according to claim 7, wherein the guiding structure comprises a rail or a guide bar.

14. The cleaning apparatus according to claim 7, wherein the recovery boiler further comprises a protective wall, wherein the protective wall and a wall of the recovery boiler define a smelt spout area therebetween, and wherein the cleaning apparatus is located in the smelt spout area.

15. An industrial robot for cleaning at least two smelt spouts of a recovery boiler one at a time, the industrial robot comprising:

a motorized cleaning member comprising a cleaning tool and configured to clean a first smelt spout of a recovery boiler; and a motorized transfer device configured to transfer the cleaning unit including the motorized cleaning member comprising the cleaning tool from a location of the first smelt spout to a location of a next, second smelt spout, wherein the motorized cleaning member comprising the cleaning tool is further configured to clean the second smelt spout.

16. The industrial robot according to claim 15, further comprising:

a carriage configured to move the industrial robot along a guiding structure and comprising at least a part of the motorized transfer device, wherein the industrial robot is connected to the guiding structure via the carriage.

17. The industrial robot according to claim 15, wherein the industrial robot is configured to travel along a guiding structure from one smelt spout to another smelt spout to clean the smelts spouts one at a time.

18. The industrial robot according to claim 15, wherein the industrial robot is further configured to open a hatch, a door or a wall.

* * * * *